US008339355B2

(12) United States Patent
Segawa et al.

(10) Patent No.: US 8,339,355 B2
(45) Date of Patent: Dec. 25, 2012

(54) LED BACKLIGHT DRIVE

(75) Inventors: Masakazu Segawa, Tokyo (JP); Mikio Araki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 281 days.

(21) Appl. No.: 12/810,484

(22) PCT Filed: Jan. 26, 2009

(86) PCT No.: PCT/JP2009/000284

§ 371 (c)(1),
(2), (4) Date: Jun. 24, 2010

(87) PCT Pub. No.: WO2009/118975

PCT Pub. Date: Oct. 1, 2009

(65) Prior Publication Data

US 2010/0283720 A1 Nov. 11, 2010

(30) Foreign Application Priority Data

Mar. 27, 2008 (JP) ..... 2008-083937

(51) Int. Cl.
*G09G 3/36* (2006.01)

(52) U.S. Cl. ..... 345/102

(58) Field of Classification Search ..... 345/102, 345/204, 690, 87

See application file for complete search history.

(56) References Cited

U.S. PATENT DOCUMENTS

| | | | | |
|---|---|---|---|---|
| 7,701,151 | B2 * | 4/2010 | Petrucci et al. | 315/309 |
| 2005/0151424 | A1 | 7/2005 | Hirosue | |

FOREIGN PATENT DOCUMENTS

| | | | |
|---|---|---|---|
| CN | 1637822 | A | 7/2005 |
| JP | 60-33390 | U | 3/1985 |
| JP | 1-181091 | U | 12/1989 |
| JP | 7-104701 | A | 4/1995 |
| JP | 2004-299528 | A | 10/2004 |
| JP | 2005-283657 | A | 10/2005 |
| JP | 2007-80819 | A | 3/2007 |
| JP | 2007-234309 | A | 9/2007 |
| JP | 2007-265806 | A | 10/2007 |
| JP | 2008-166065 | A | 7/2008 |

* cited by examiner

*Primary Examiner* — Stephen Sherman
(74) *Attorney, Agent, or Firm* — Birch, Stewart, Kolasch & Birch, LLP

(57) ABSTRACT

An LED backlight drive for driving an LED backlight having a plurality of LED lines L1-L3 connected in parallel to a power feed line S4, each of the LED lines having an arbitrary number of LEDs connected in series, the LED backlight drive including: an arithmetic section 12 for calculating a delay time from driving one of the plurality of LED lines L1-L3 to driving the next LED line; a signal generator 13 for generating a plurality of control signals successively at intervals corresponding to the delay time calculated by the arithmetic section; and a driver 14 for driving the plurality of LED lines successively in response to the plurality of control signals generated by the signal generator.

1 Claim, 2 Drawing Sheets

LED BACKLIGHT DRIVE

TECHNICAL FIELD

The present invention relates to an LED backlight drive for driving a light emitting diode (abbreviated to "LED" from now on) backlight used as a backlight of a liquid crystal display (abbreviated to "LCD" from now on).

BACKGROUND ART

Recently, as a light source of a backlight of an LCD, LEDs have come to be used instead of a conventional cold cathode fluorescent lamp (CCFL). As for the LCDs, however, higher brightness LEDs are desired. To meet this, LED backlights have been developed which have a plurality of LED lines, each of which includes a plurality of LEDs connected in series. Such an LED backlight adjusts the emission quantity of the LEDs by carrying out PWM (Pulse Width Modulation) control of a current supplied to each LED line from a power supply via a power feed line. However, when driving all the LED lines with a driving signal having the same waveform, a large current flows instantaneously, thereby inducing ripples on the power feed line, which causes screen noise and the like.

As a technique for solving such a problem, Patent Document 1 discloses a display unit that improves display characteristics by reducing a current ripple component. The display unit has a plurality of power driving sections for supplying prescribed driving power to the light source, and a control section for controlling the plurality of power driving sections in such a manner that the currents output from the individual power driving sections have a prescribed phase difference.

Patent Document 1: Japanese Patent Laid-Open No. 2007-80819.

The technique disclosed in the foregoing Patent Document 1 requires a plurality of power driving sections for each LED line. Accordingly, trying to provide a plurality of LED lines to achieve the high brightness necessitates a great number of power driving sections, thereby offering problems of requiring a large mounting area and increasing the cost.

The present invention is implemented to solve the foregoing problems. Therefore it is an object of the present invention to provide an inexpensive LED backlight drive capable of driving the LED backlight with a simple configuration.

DISCLOSURE OF THE INVENTION

To solve the foregoing problems, an LED backlight drive in accordance with the present invention includes, in an LED backlight drive for driving an LED backlight having a plurality of LED lines connected in parallel to a power feed line, each of the LED lines having an arbitrary number of LEDs connected in series, an arithmetic section for calculating a delay time from driving one of the plurality of LED lines to driving a next LED line; a signal generator for generating a plurality of control signals successively at intervals corresponding to the delay time calculated by the arithmetic section; and a driver for driving the plurality of LED lines successively in response to the plurality of control signals generated by the signal generator.

According to the LED backlight drive, since it is configured in such a manner as to calculate the delay time from driving one of the plurality of LED lines to driving the next LED line, and to drive the plurality of LED lines successively by generating the plurality of control signals successively at intervals corresponding to the delay time calculated, it can obviate the need for having a plurality of power driving sections for each of the LED lines, thereby being able to drive the LED backlight with a simple, inexpensive configuration.

BEST MODE FOR CARRYING OUT THE INVENTION

The best mode for carrying out the invention will now be described with reference to the accompanying drawings.

Embodiment 1

Figure 1:
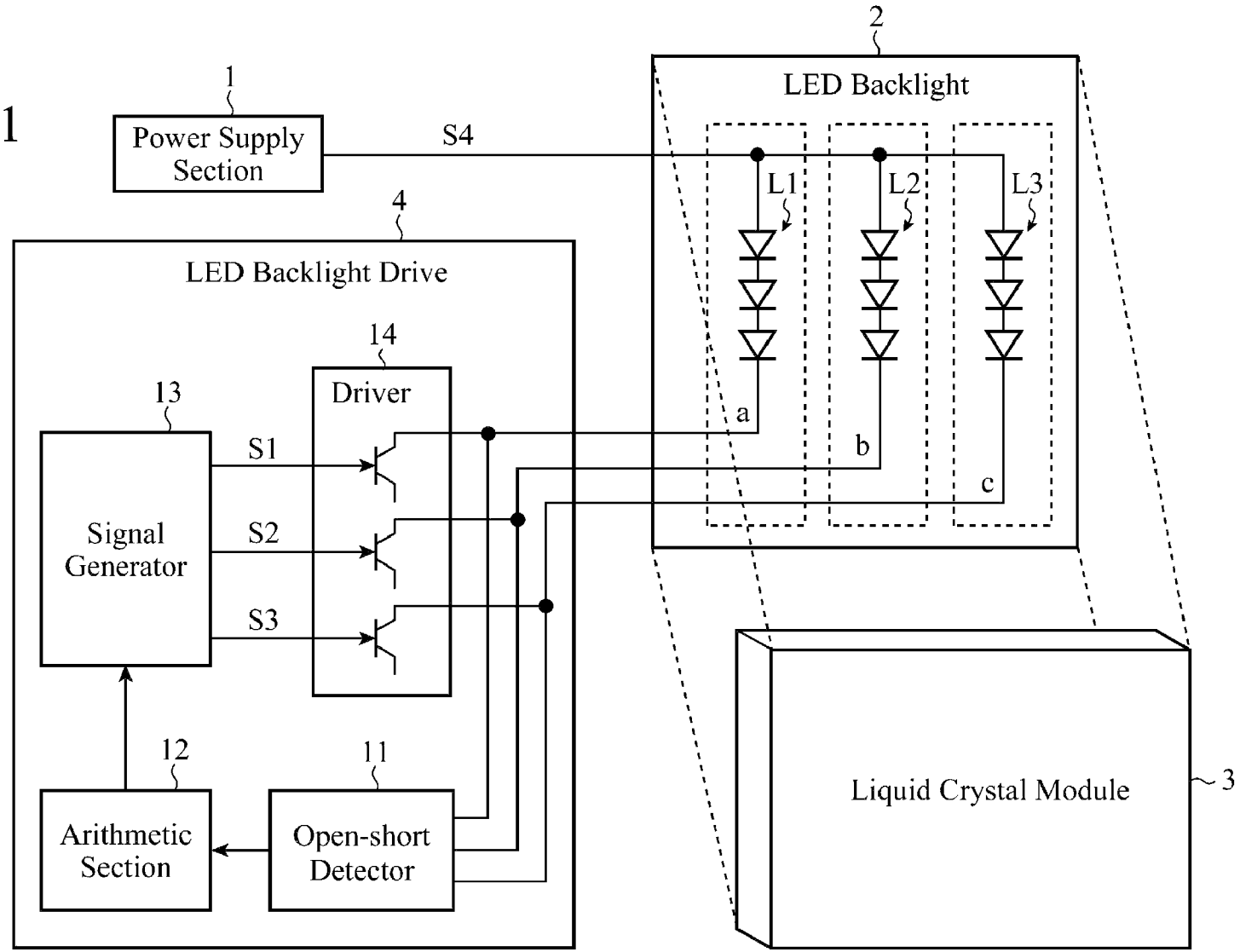
FIG. 1 is a block diagram showing a configuration of an LED backlight drive of an embodiment 1 in accordance with the present invention.

FIG. 1 is a block diagram showing a configuration of the liquid crystal display unit to which the LED backlight drive of an embodiment 1 in accordance with the present invention is applied. The liquid crystal display unit has a power supply section 1, an LED backlight 2, a liquid crystal module 3 and an LED backlight drive 4.

The power supply section 1 generates a current for driving the LED backlight 2. The current generated by the power supply section 1 is fed to the LED backlight 2 via a power feed line S4.

The LED backlight 2 has a first LED line L1, a second LED line L2 and a third LED line L3, each of which consists of a plurality of LEDs connected in series. The LEDs at first ends of the first LED line L1, second LED line L2 and third LED line L3 have their anodes connected in common to the power supply section 1 via the power feed line S4, and the LEDs at their second ends have their cathodes connected to the LED backlight drive 4 separately.

The liquid crystal module 3 has a driver IC for driving, which is mounted on a liquid crystal panel. The liquid crystal module 3 has its back surface irradiated with the light emitted from the LED backlight 2 so as to display characters and figures on the surface of the liquid crystal panel at prescribed luminance.

The LED backlight drive 4 drives the LED backlight 2. The LED backlight drive 4 comprises an open-short detector 11, an arithmetic section 12, a signal generator 13 and a driver 14.

The open-short detector 11 detects the presence or absence of the connection of each of the LED lines constituting the LED backlight 2, thereby detecting the number of the LED lines connected to the LED backlight drive 4. In this case, if any defect such as an open failure is detected in an LED line, the LED line is detected as disconnected. Thus, the number of the LED lines other than the faulty LED lines is detected. The number of the LED lines detected by the open-short detector 11 is delivered to the arithmetic section 12.

According to the number of the LED lines delivered from the open-short detector 11, the arithmetic section 12 calculates the delay time from driving one of the plurality of LED lines to driving the next LED line. The arithmetic section 12 delivers the delay time it calculates to the signal generator 13 as a delay time signal.

The signal generator 13 successively generates control signals S1, S2 and S3 at intervals corresponding to the delay time indicated by the delay time signal delivered from the arithmetic section 12, and delivers them to the driver 14.

As for the arithmetic section 12 and signal generator 13, a microcomputer is used for constituting them.

The arithmetic section 12 comprises a receiving section (not shown) for receiving information on the number of the LED lines from the open-short detector 11; a computing section (not shown) for calculating the delay time from driving one of the LED lines to driving the next LED line in accordance with the number of the LED lines; and a transmitting section (not shown) for delivering the information on the delay time Td to the signal generator 13.

The signal generator 13 comprises a delay generating section (timer) (not shown) for actualizing the delay time delivered from the arithmetic section 12, and a transmitting section (not shown) for delivering the control signals (S1, S2 and S3) to the driver 14.

The driver 14 is composed of three transistors, for example, which are turned on and off in response to the control signals S1, S2 and S3 from the signal generator 13, and drive or stop driving the first LED line L1, second LED line L2 and third LED line L3 constituting the LED backlight 2, respectively.

Figure 2:
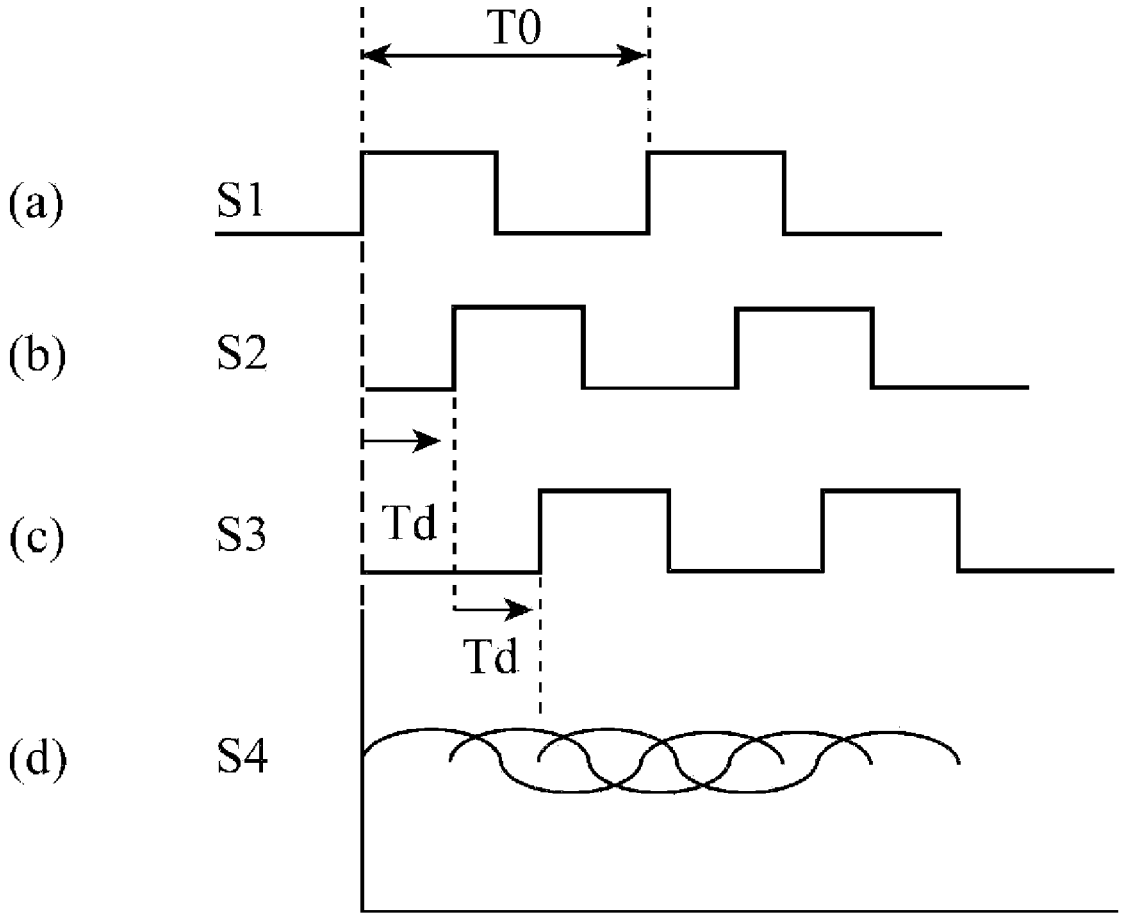
FIG. 2 is a timing chart showing the operation of the LED backlight drive of the embodiment 1 in accordance with the present invention.

Next, the operation of the liquid crystal display unit with the foregoing configuration will be described with reference to the timing chart shown in FIG. 2.

First, the number n of the LED lines connected is detected. More specifically, the open-short detector 11 detects the number n of the LED lines connected to the LED backlight drive 4 by detecting whether the first LED line L1, second LED line L2 and third LED line L3 constituting the LED backlight 2 are connected or not, and delivers the number n of the LED lines to the arithmetic section 12.

Subsequently, the delay time Td is calculated. More specifically, according to the number n of the LED lines delivered from the open-short detector 11, the arithmetic section 12 calculates the delay time Td from driving one of the LED lines to driving the next LED line. Assume here that the frequency of the PWM control is f0 [Hz], then its period T0 is given by "T0=1/f0". When the number of the LED lines is n, the delay time Td is calculated as "T0/n". For example, when the period of the PWM control is f0=8.3 [kHz], and the number n of the LED lines is three, the period T0 becomes 1/8.3 k=120 [μs], and the delay time Td becomes 120 [μs]/3=40 [μs].

Subsequently, the first LED line L1 is driven. More specifically, the signal generator 13 generates the control signal S1 with the ON width that undergoes the PWM control as shown in FIG. 2(*a*), first, and delivers it to the driver 14. This brings the transistor constituting the driver 14 into the ON state, and drives the first LED line L1. As a result, the LEDs on the first LED line L1 are switched on.

Subsequently, the second LED line L2 is driven. More specifically, after the delay time Td delivered from the arithmetic section 12 has elapsed after generating the control signal S1 as shown in FIG. 2(*b*), the signal generator 13 generates the control signal S2 with the ON width that undergoes the PWM control, and delivers it to the driver 14. This brings the transistor constituting the driver 14 into the ON state, and drives the second LED line L2. As a result, the LEDs on the second LED line L2 are switched on.

Subsequently, the third LED line L3 is driven. More specifically, after the delay time Td delivered from the arithmetic section 12 has elapsed after generating the control signal S2 as shown in FIG. 2(*c*), the signal generator 13 generates the control signal S3 with the ON width that undergoes the PWM control, and delivers it to the driver 14. This brings the transistor constituting the driver 14 into the ON state, and drives the third LED line L3. As a result, the LEDs on the third LED line L3 are switched on.

After that, in the same manner as described above, the first LED line L1, second LED line L2 and third LED line L3 are successively driven again to repeat the driving. FIG. 2(*d*) shows a manner in which the current on the power feed line S4 varies during the foregoing operation. Unlike the conventional example, since the first LED line L1, second LED line L2 and third LED line L3 are not driven simultaneously, the current does not vary sharply at any places. In addition, since the first LED line L1, second LED line L2 and third LED line L3 are driven successively, places where the current varies a little are distributed. As a result, the ripples on the power feed line S4 are small as a whole, and this enables suppressing the screen noise.

Incidentally, as for the number of LED lines of the LED backlight drive of the foregoing embodiment 1, although an example is described above of driving the three LED lines consisting of the first LED line L1, second LED line L2 and third LED line L3 as shown in FIG. 1, the number of LED lines is not limited to three but can be set arbitrarily.

As described above, according to the LED backlight drive of the embodiment 1 in accordance with the present invention, it is configured in such a manner as to calculate the delay time Td from driving one of the plurality of LED lines L1-L3 to driving the next LED line, and to drive the plurality of LED lines L1-L3 successively by generating the plurality of control signal S1-S3 successively at time intervals corresponding to the delay time Td calculated. Accordingly, it can obviate the need for having a plurality of power driving sections for each LED line, thereby being able to provide an LED backlight drive capable of driving the LED backlight with a simple and inexpensive configuration. In addition, since it can remove such a component as an inductor for reducing ripples, it can reduce the mounting area and cost.

INDUSTRIAL APPLICABILITY

As described above, since the LED backlight drive in accordance with the present invention is configured in such a manner that it has a plurality of LED lines for achieving high brightness, and that to solve the problems of requiring a large mounting area and high cost, it calculates the delay time from driving one of the plurality of LED lines to driving the next LED line, and drives the plurality of LED lines successively by generating the plurality of control signals successively at time intervals corresponding to the delay time, it can obviate the need for having a plurality of power driving sections for each LED line, and can drive the LED backlight with a simple, inexpensive configuration.

What is claimed is:

1. An LED backlight drive for driving an LED backlight having a plurality of LED lines connected in parallel to a power feed line, each of the LED lines having an arbitrary number of LEDs connected in series, the LED backlight drive comprising:

an arithmetic section for calculating a delay time from driving one of the plurality of LED lines to driving a next LED line;

a signal generator for generating a plurality of control signals successively at intervals corresponding to the delay time calculated by the arithmetic section;

a driver for driving the plurality of LED lines successively in response to the plurality of control signals generated by the signal generator; and an open-short detector for detecting the number of the LED lines connected, wherein the arithmetic section calculates the delay time in accordance with the number of the LED lines detected with the open-short detector, and the open-short detector detects the number of the LED lines connected except for a faulty LED line.

* * * * *